US005960540A

United States Patent [19]

Pentz

[11] Patent Number: 5,960,540

[45] Date of Patent: Oct. 5, 1999

[54] INSULATED WIRE WITH INTEGRAL TERMINALS

[75] Inventor: Edward LeRoy Pentz, Greensboro, N.C.

[73] Assignee: The Whitaker Corporation, Wilmington, Del.

[21] Appl. No.: 08/946,122

[22] Filed: Oct. 7, 1997

Related U.S. Application Data

[60] Provisional application No. 60/030,622, Nov. 8, 1996, and provisional application No. 60/042,215, Mar. 31, 1997.

[51] Int. Cl.[6] ..... H01R 43/04

[52] U.S. Cl. ..... 29/861; 29/863; 29/33 M

[58] Field of Search ..... 29/861, 863, 825, 29/846, 33 M

[56] References Cited

U.S. PATENT DOCUMENTS

| | | | |
|---|---|---|---|
| 650,861 | 6/1900 | McTighe | 29/863 X |
| 1,147,450 | 7/1915 | Shaw | 29/863 X |
| 1,392,558 | 10/1921 | Darrah et al. . | |
| 1,642,696 | 9/1927 | Rateike . | |
| 1,872,022 | 8/1932 | White | 29/861 X |
| 1,937,431 | 11/1933 | Mendel | 29/863 |
| 2,000,909 | 5/1935 | Alsaker | 29/863 |
| 2,015,418 | 9/1935 | Wermine | 173/361 |
| 2,323,758 | 7/1943 | Temple, Jr. | 29/863 X |
| 2,911,614 | 11/1959 | Davis . | |
| 2,965,147 | 12/1960 | Hoffman | 29/863 X |
| 2,989,578 | 6/1961 | Wagner et al. | 174/84 |
| 3,229,241 | 1/1966 | Kao . | |
| 3,281,923 | 11/1966 | Best et al. . | |
| 3,402,466 | 9/1968 | Phillips . | |
| 3,753,214 | 8/1973 | DuRocher et al. . | |
| 3,764,943 | 10/1973 | Fort | 333/79 |
| 3,956,823 | 5/1976 | Kuo | 29/863 |
| 4,089,106 | 5/1978 | Seidler . | |
| 4,544,220 | 10/1985 | Aiello et al. . | |
| 4,775,337 | 10/1988 | Van Wagener et al. | 439/883 |
| 5,191,710 | 3/1993 | Fujimaki et al. | 29/863 |
| 5,393,951 | 2/1995 | Kasper | 29/861 X |
| 5,399,110 | 3/1995 | Morello et al. | 439/879 |
| 5,423,120 | 6/1995 | Kaneko | 29/884 |

FOREIGN PATENT DOCUMENTS

| | | |
|---|---|---|
| 0 129 872 | 1/1985 | European Pat. Off. . |
| 2 133 208 | 11/1972 | France . |
| 916077 | 8/1954 | Germany . |
| 40 13 620 C1 | 7/1991 | Germany . |
| 245586 | 1/1926 | United Kingdom . |

OTHER PUBLICATIONS

Solid State Stamping, Inc. Exclusive "Upset" Technology (2 pages).

American Society for Metals, *Metals Handbook*, 8th Edition, vol. 4, "Forming", pp. 470–488.

*Primary Examiner*—Carl J. Arbes

*Attorney, Agent, or Firm*—Bradley N. Ditty

[57] ABSTRACT

Integral terminals are formed on the bare ends 4, 24, 64, 84 of insulated wires 2, 22, 62, 82. Male and female terminal configurations are stamped and formed on the wires. When necessary the bare wire ends are upset to increase the width of the portion of the bare wire on which the terminals are formed. Cylindrical pins 10 can be formed by removing material and cylindrical sockets 8 can be formed by drilling and reaming the end of a wire that may have been upset by a cold heading operation. Retention flanges 38 can be formed to retain pins 30 and sockets 28 in a connector housing 40. Hermaphroditic blade terminals 62 can also be formed on bare wire ends. Quick disconnect tabs 92 can be formed by forming a flat blank from the bare wire 84 or from an upset section 88.

17 Claims, 9 Drawing Sheets

INSULATED WIRE WITH INTEGRAL TERMINALS

This application claims benefit of Provisional application Ser. No. 60/030,622 filed Nov. 8, 1996, and a provision of application Ser. No. 60/042,215 filed Mar. 31, 1997.

BACKGROUND OF THE INVENTION

1. Field of the Invention

This invention is related to the use of insulated wires and to the use of terminals on the end of the wires to form an electrical connection. This invention is also related to the fabrication of integral terminals on bare wire ends of an insulated wire.

2. Background of the Invention

There are a number of conventional ways to terminate or connect a bare wire formed by stripping the insulation from the end of a wire. The bare wire can be soldered or spliced to another conductor. The bare wire may also be wrapped around a post or positioned under a screw, or a wire nut may be used to connect two wires.

For many applications terminals are crimped or attached to the bare wire and these terminals are then mated with a mating terminal. Conventional terminals are generally formed by either screw machining or by stamping and forming. Although terminals can provide added reliability to an electrical connection and they can simplify an operators wiring task, they do represent an additional component and an additional operation. Therefore the use of separate terminals does have some cost, including the cost to fabricate the terminal and the cost to apply the terminal. In most instances this cost is less than the advantages that can be realized by the use of pin and socket, quick disconnect tab and receptacle, blade terminals, printed circuit board terminals or any of the myriad other types of standard electrical connector terminals.

One way of fabricating conventional terminals is to stamp and form the terminals from a continuous wire having either a circular or a square cross section. Simple blade or tab configurations are easily stamped and formed using a wire blank. Cylindrical pins can also be easily fabricated in this manner. One standard method of forming printed circuit board pins that are soldered in printed circuit board holes is to use wire pins. Straight and right angle pins are often fabricated from bare wire stock. Typically some forming of pins manufactured in this manner is necessary. For example the pins can be bent and chamfer or tapered lead in sections are formed on the ends of these pins to prevent stubbing when the pins are connected to a mating receptacle connector. Some applications also require the use of pins having a first diameter on one end and a second diameter on the other end. For example, the proper diameter for use with a standard printed circuit board hole may not correspond to the desired pin diameter to interface with a standard receptacle connector terminal. One method of forming a pin having two different diameters at opposite end is to first coin a wire where the smaller diameter section is to be located. After the wire is coined, the coined section can be trimmed in a stamping operation to remove a specified amount of material. The coined and trimmed section can then be formed into a cylindrical section having a diameter that is smaller than the original diameter of the wire. Alternatively a pin having a local diameter that is to be larger than the diameter of the wire stock can be subject to a cold heading or upsetting operation to increase the local diameter by shortening the length of the local wire section. This upset section can then be formed into a cylindrical pin having a larger local diameter.

SUMMARY OF THE INVENTION

Some of the additional costs associated with the fabrication and installation of discrete terminals can be eliminated by forming the terminals directly on the bare ends of insulated wires. This integral fabrication approach is especially useful for miniature applications employing small terminals that can be relatively more expensive to manufacture and to install.

A significant stock saving, when compared to stamping and forming, is also possible. When a terminal is stamped and formed from a flat blank, forth to sixty percent of the strip stock from which the terminal is stamped and formed is scrap. Using the method described and claimed herein, there is little if any scrap.

By forming the terminals directly from the bare end of the insulated wire, one mechanical interface is eliminated. There is no crimp or solder joint between the wire and the terminal. It is therefore unnecessary to monitor crimp resistance since problems associated with relaxation of the crimp with time and any other crimp reliability problems are eliminated.

One method according to this invention includes the steps of stripping the insulation to expose bare wire ends. These bare wire ends can then be upset to increase the cross sectional area of a portion of the bare wire end. To increase the outer diameter of this upset portion of the bare wire, the length of the bare wire is reduced during the upsetting or cold heading operation. The upset portion of the wire can then be formed into a final terminal configuration. Among the terminal configurations that can be formed in this manner are pin and socket terminals, blade terminals, hermaphroditic blade terminals, and quick disconnect tabs. In addition to upsetting the bare wire ends to form the mating portion of the terminals, retention flanges and shoulders having a diameter greater than the wire diameter and the diameter or width of the mating portion of the terminal can be formed. These retention flanges can then be used to engage latches or surfaces of connector housings to secure the terminated wires to a conventional style electrical connector housing. Alternatively, the edges of the wire can be coined to form retention shoulders or flanges between the mating terminal section and the insulation surrounding the conductive core of the insulated wire.

A second related method can be used to fabricate terminal configurations that are smaller than the wire. The stripped bare wire end can be first coined and then the edges of the coined section can be trimmed in a stamping operation to remove excess material. The remaining coined section can then be formed in a die into a terminal shape. This method is especially useful in fabricating pins.

BRIEF DESCRIPTION OF THE DRAWINGS

FIG. 6 shows a stripped end of a wire. FIG. 7 shows the bare wire after it is axially upset. FIG. 8 shows the upset section of the bare wire after it has been flattened.

FIG. 9 shows a tab blank stamped from the flattened bare wire shown in FIG. 8. FIG. 10 shows an integral tab that is dimensionally identical to a standard quick disconnect tab.

DETAILED DESCRIPTION OF EMBODIMENTS OF THE INVENTION

Figures 1, 2:
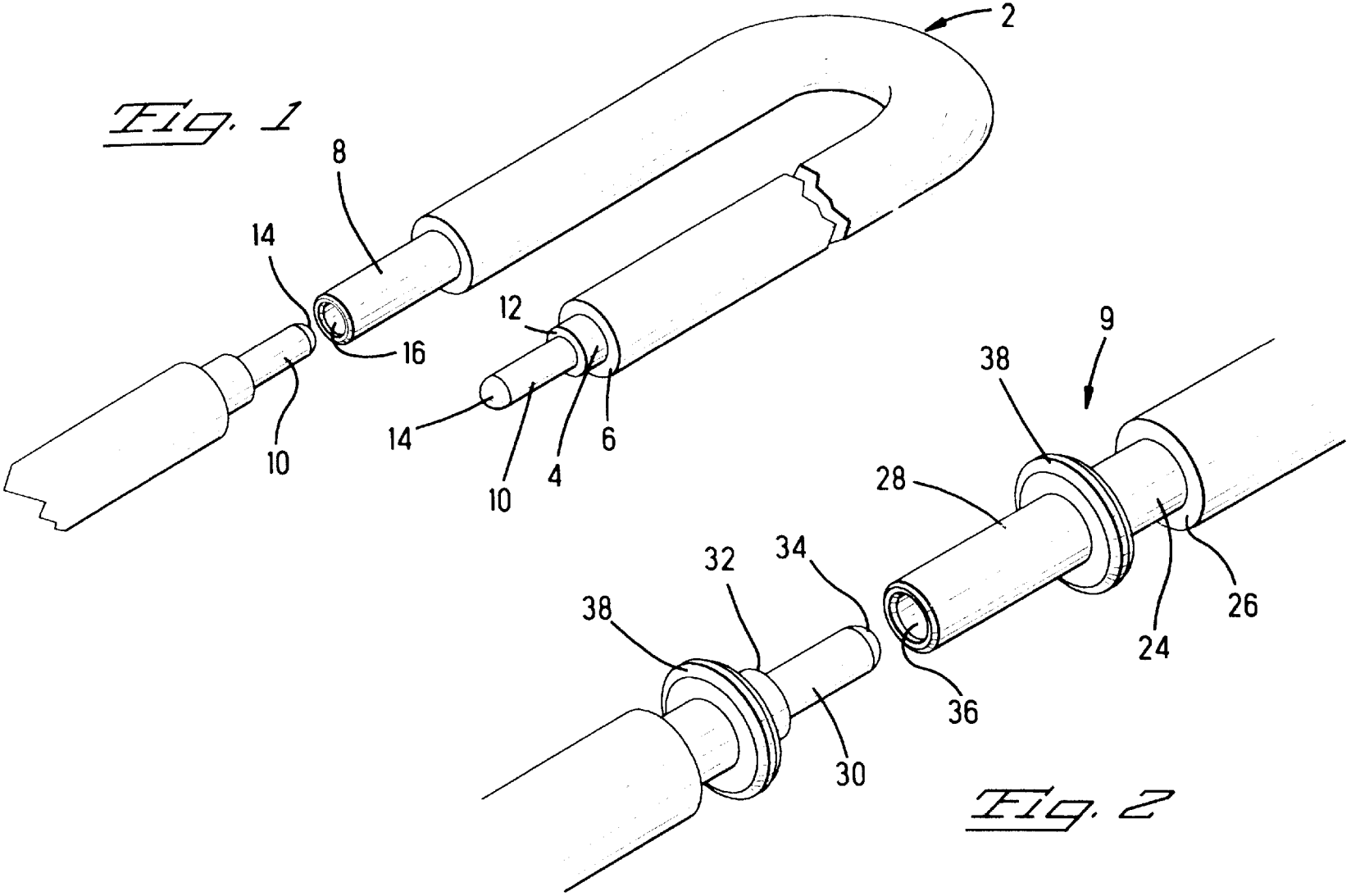
FIG. 1 is a view of an insulated wire having an integral pin terminal formed from the conductive core of the wire on one end and an integral socket terminal formed from-the conduction core of the wire on the other end.
FIG. 2 is a view similar to FIG. 1 showing mating ends of two wires in which both integral pins and integral sockets include an upset retention flange.
Figure 3:
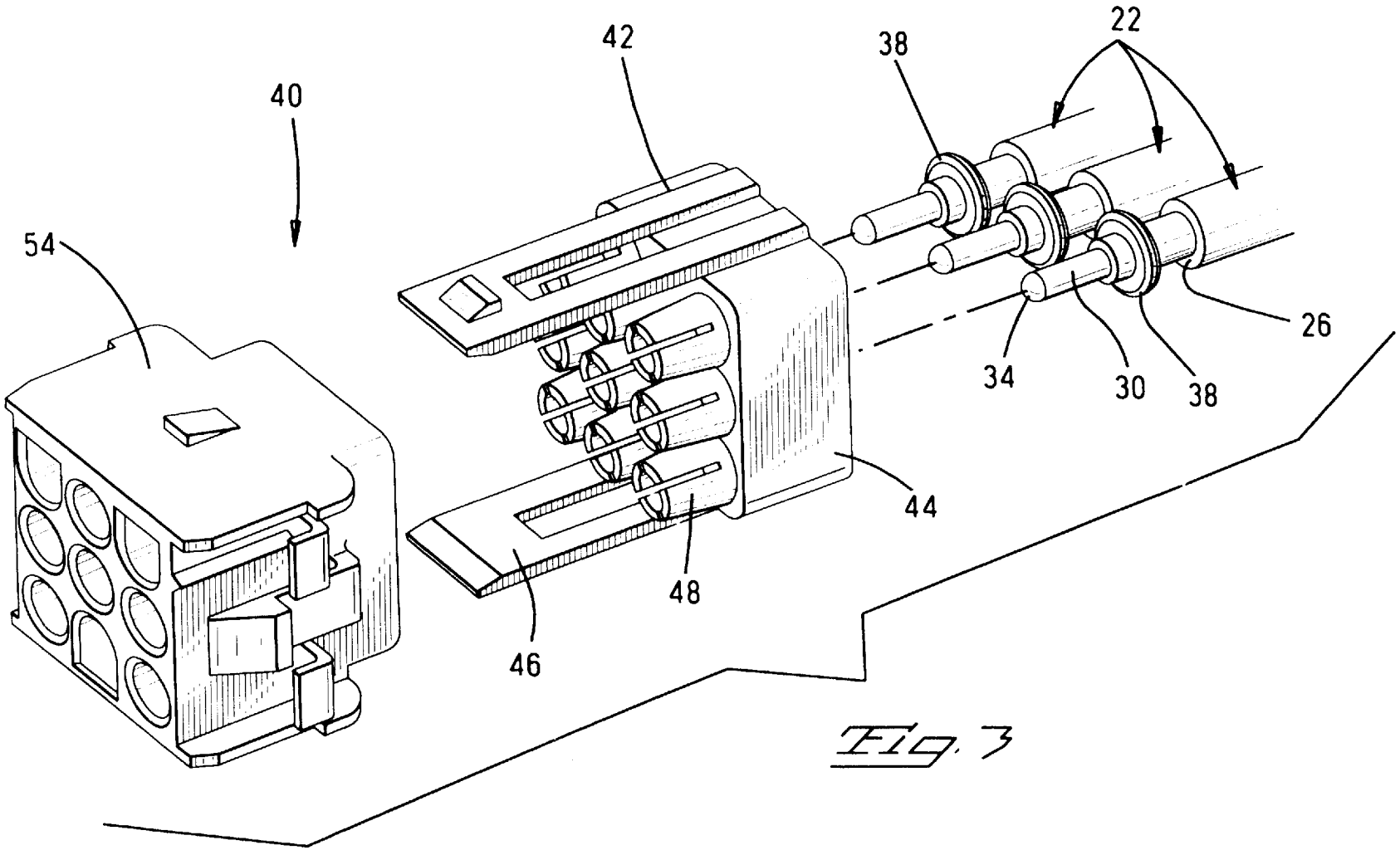
FIG. 3 is an exploded perspective view showing the manner in which the pin terminal ends of a wire can be positioned in an insulated connector housing.
Figure 4:
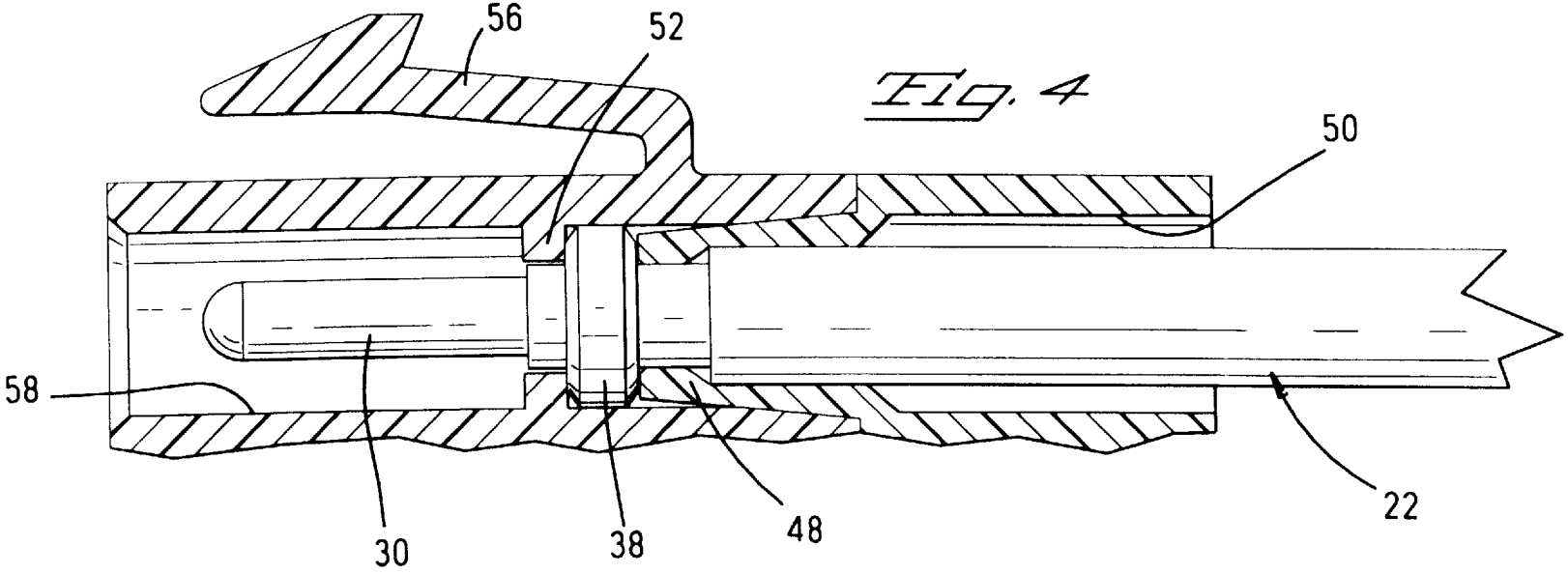
FIG. 4 is a partial section view of the position of the pin terminal end of a wire positioned in a terminal cavity of the connector housing shown in FIG. 3.
Figure 5:
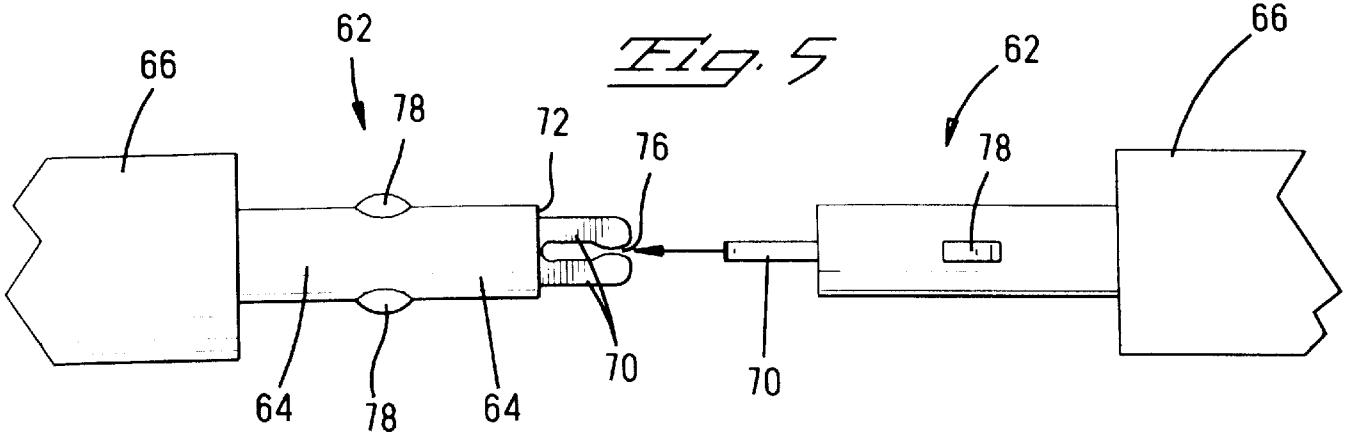
FIG. 5 shows insulated wires with hermaphroditic blade contacts formed on mating ends.
Figure 6:
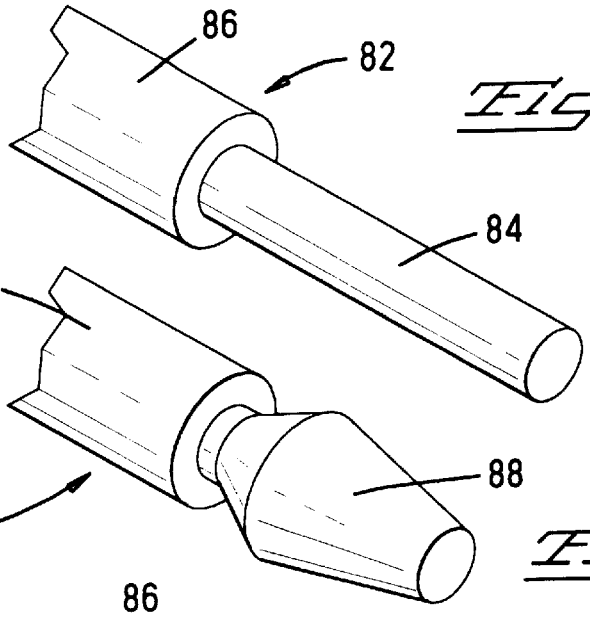
FIGS. 6–10 show sequential steps for forming a quick disconnect tab on the end of a wire.

Several different embodiments of terminal configurations integrally formed on an insulated wire by forming a bare wire end are disclosed herein. FIG. 1 shows a simple pin and socket terminal configuration and FIGS. 2–4 show a pin and socket embodiment in which both the pin and socket include a cylindrical retention flange for positioning the terminals in a standard insulated connector housing. FIG. 5 shows a hermaphroditic blade contact with coined retention sections formed on the bare wire ends of an insulated wire. FIGS. 6–10 show typical fabrication steps for forming a standard quick disconnect tab on the end of a wire.

FIG. 1 shows a terminated wire 2 that includes conventional stand alone pin and socket terminals integrally formed on opposite ends of the wire. Insulation 6 has been removed to expose the bare wire 4 at both ends of wire 2. On one end of wire to a socket 8 or cylindrical female contact or terminal has been formed. On the opposite end of the wire a cylindrical pin 10 or male terminal has been formed. The pin 10 formed on one end of the wire 2 has a configuration that will mate with a socket 8 formed on the end of another wire 2. Thus the terminated wires 2 shown in FIG. 1 could function as jumpers. Multiple terminated wires 2 could also be assembled as a harness without the addition of terminals. Terminated wires 2 could also be formed with pins 10 on both ends or with sockets 8 on both ends depending upon the specific application in which they are to be used.

The pin 10 in the embodiment of FIG. 1 has a diameter that is less than the diameter of the wire conductor as shown by the neckdown shoulder 12. This smaller diameter pin 10 can be fabricated by first coining the end of the bare wire 4 and then trimming excess material from the edges of the coined section in a stamping operation. The cylindrical pin section would then by formed by appropriately shaped dies. The radiused pin lead in 14 would also be formed in a die.

The socket 10 could be formed by drilling a hole in the end of the wire and then reaming the hole to define a bore 16 of the required dimension. In some cases it would not be possible to drill and ream a hole 16 of the proper size because the outer diameter of the bare wire 4 would not be sufficient. For those applications, the bare wire 4 could be upset to form a section having a larger diameter by using a cold heading operation.

Necking and body flanging are other techniques that can be used to increase the local diameter of a wire. When the bare wire is upset by the application of an axial force, the length of the bare wire 4 is reduced so that material is available to form a section having a greater diameter or cross sectional area even though the total volume of the material is not changed. For applications in which a socket 8 is formed on one end of the wire and a pin 10 is formed on the other end, it will generally be necessary to alter the diameter of either or both the socket 8 and the pin 10 in this manner. It may also be necessary to form either the socket 8 or the pin 10 into some configuration other than a true right circular cylinder so that adequate mating force can be supplied when a socket 8 of this type is mated with a pin 10. One technique for achieving this result would be to form the socket 8 or the pin 10 in a slightly oval configuration so that the socket 8 would be deformed when an oval member is mated with a member having a right circular cross section. Alternatively slots could be formed in the socket 8 so that the socket could expand when mated with a pin to impart adequate mating force. These slots could be open ended, extended to the distal end of the socket to form cantilever beams. Alternatively the socket could be slotted leaving beams supported at opposite ends and dimples or radiused contact sections could be formed on these beams.

Sockets or female terminals could also be formed by reverse drawing the wire in a manner similar to that used to form eyelets.

The configuration of FIG. 1 would be especially useful for a miniature connector configuration using wires having a relatively small diameter. For example, this configuration could be used with a 22 AWG wire having a diameter of 0.025 inch. For smaller wires of this type, the cost of a conventional stamped and formed terminal can represent a relatively higher part of the assembly because of the need to fabricate terminals of relative small size. This configuration would be especially useful in fabricating small diameter pins that are necessary for some miniature applications. Instead of having to stamp and form a small wire pin that must be crimped to a small wire, the pin could be formed directly on the wire. In some miniature application, it could be cost effective to use a wire having a diameter greater than would otherwise be required. A smaller diameter pin, such as pin 10 could be formed on this larger diameter wire and the difficulty of forming a miniature crimped pin terminal would be avoided.

FIGS. 2–4 show a version of a pin and socket connector configuration in which integral terminals formed on bare ends 24 of an insulated wire 22 can be positioned in a connector housing 54 of a conventional type. The bare wire terminals formed on this wire 22 are also of the pin and socket type. Sockets 28 and pins 30 are formed on the bare wire sections 24 extending beyond the location at which the insulation 26 is stripped. As with the configuration of FIG. 1, the pin 30 is formed on the smaller diameter end of the bare wire 24 that extends beyond a necked down transition shoulder 32. A tapered or radiused lead in 34 is formed on the forward end of the pin contact 30. Pin 34 is formed in substantially the same manner as the pin 10 in the embodiment of FIG. 1. The socket 28 and the pin receiving socket bore 36 are also formed in substantially the same manner as the socket 8. Both the socket 28 and the pin 30 differ from the embodiments of FIG. 1 in that a cylindrical retention flange or shoulder 38 is formed between the mating ends of the sockets 28 or pin 30 and the end of the insulation 26. The outer diameter of the cylindrical retention shoulder 38 is greater than the outer diameter of the socket 28, the pin 30 and the undeformed portions of the bare wire 24. A multiple stroke center upset is used to fabricate this shoulder flange 38. Two or three step center upsets can be used to form a shoulder of collar of this type that is two and one-half to three times the original diameter of the wire.

FIGS. 3 and 4 show the manner in which the pin terminals 30 can be positioned in a conventional type connector housing 40. A socket terminal 28 could also be positioned in a housing of this type in the same manner. The two piece insulated housing 40 includes a terminal retainer 42 and a main connector housing 54. The terminal retainer 42 has cylindrically arranged resilient fingers 48 aligned with retainer passages or cavities 50. The integral pin contacts 30 on terminated wires 22 are inserted into the cavities 50. The fingers 48 are deflected outwardly to allow the cylindrical shoulder 38 on each terminated wire 22 to pass through the fingers 48. When the pin contacts 30 and the cylindrical retention shoulder are fully inserted, the fingers return to their original position where the fingers 48 engage the rear of the retention shoulders 38 to prevent withdrawal of the terminated wires 22 and the pin contacts 30 from the terminal retainer.

Terminal retainer 42 includes resilient latches 46 extending from the body 44 of the retainer. These latches 46 secure the terminal retainer 42 to the main connector body 54. The main connector body 54 includes mating passages 58 opening on a front mating face of the connector body 54. The mating section of pin contacts 30 extend into the mating passages 58 when the retainer 42 is latched to the main connector body 54. Stop surfaces 52 extend into each mating passage 58 and the cylindrical retention shoulders 38 on corresponding terminated wires 22 abuts the corresponding stop 22 when fully inserted into the mating passage 58. These stops 52 prevent further movement of the pin contacts 30 and the terminated wires into the connector body 54. The main connector body also includes a latch 56 that secures the main connector body 54 to a mating connector of conventional construction (not shown). The mating connector could include sockets 28 formed integrally on a wire or could employ conventional stamped and formed sockets of appropriate size.

Although cylindrical pin and socket terminals are particularly suitable for fabrication as integral parts of a terminated wire, they are not the only terminal configurations that can be fabricated in the manner depicted herein. FIG. 5 shows a hermaphroditic blade contact configuration that can be formed integrally on the bare wire end 64 extending beyond the insulation 66 of a terminated round wire 62. In this configuration flat blade contacts each having two opposed beams 70 are formed on the bare wire 64. To form these flat slotted beams, the round bare wire is first coined or formed in a flat section. This flat section can then be stamped to remove excess material to form the slotted beams 70 and to remove excess material when the flat beams 70 do not require the same amount of material as the round wire. The slotted beams 70 each have a radiused section 76 protruding inwardly at the end of the slotted beam so that the slot width is less at the end of the beams. Two identical blade contact can be mated with one extending perpendicular to the other. The slotted beams spring outward during mating and the radiused sections 76 enter the larger portions of the slots so that a spring connection is formed. Retention shoulders 78 can be formed by coining opposite sides of the bare wire 64 between the slotted beams 70 and the end of the insulation 66. Protruding coined retention shoulders 78 will engage retention surfaces on a connector body in which the terminated wires 62 are positioned.

Figure 7:
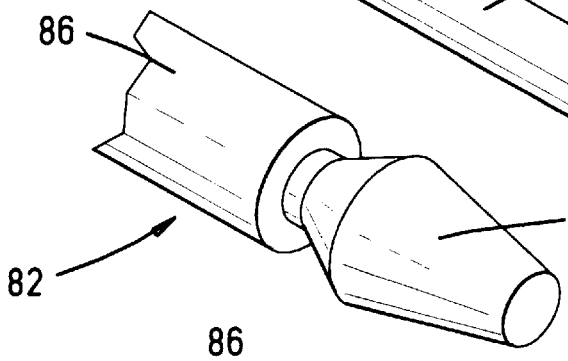
Figure 8:
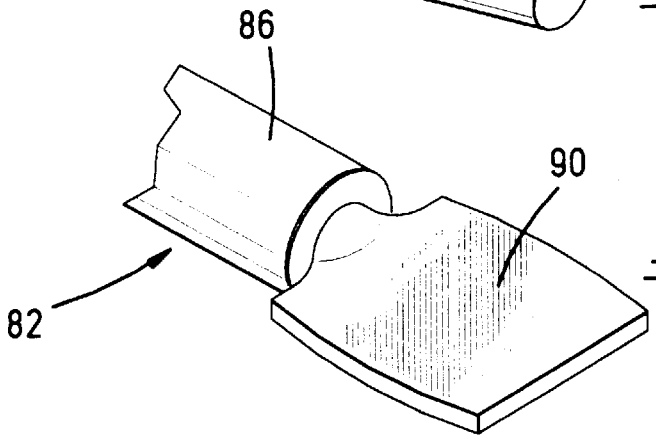
Figure 9:
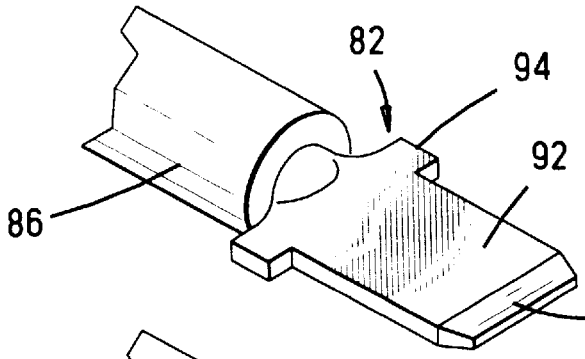
Figure 10:
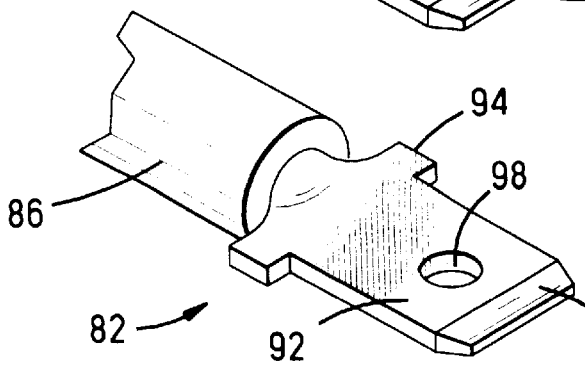

FIGS. 6–10 depict the main steps for fabricating a flat blade contact having the same configuration as a quick disconnect tab. Conventional stamped and formed quick disconnect terminals of this type are crimped to wires and are commonly used for a wide variety of applications. One version of these quick disconnect terminals is manufactured by AMP Incorporated and are marketed as FASTON electrical connectors. FASTON is a trademark of The Whitaker Corporation. The terminated wire 82 with quick disconnect tabs is formed by first stripping the insulation 86 to expose a section of bare wire 84. As shown in FIG. 7, the bare wire section 84 is then upset by an end cold heading operation to reduce the length of the bare wire section 84 and to increase its width. More material will thus be located within a given length of the bare wire section 84 and this additional material will be necessary for producing tabs that have a large size relative to the wire diameter. Quick disconnect tabs and receptacles can be used for wire sizes ranging at least from 14 AWG to 30 AWG. This upsetting or cold heading operation will be especially important for the smaller wire sizes. After the bare wire section 84 is upset, the upset section 88 is then formed into a flat blank 90 as shown in FIG. 8. The flat blank 90 is then stamped to form a stamped tab blank of substantially the same basic shape as a standard quick disconnect tab. Stop shoulders 94 are formed along the base of the tab blank and a tapered and chamfered lead end 96 is formed on the front of the tab blank. As shown in FIG. 10, a retention hole 98 can then be stamped in the tab blank to form a quick disconnect tab 92 having the same dimensions and configuration as a standard stamped and formed quick disconnect tab that would crimped onto a wire.

Each of the terminal configurations would be fabricated by a transfer mechanism that would transfer the wire, and the bare wire ends laterally between different stations. The use of transfer machines would differ from the use of progressive dies that perform successive operations on a metal strip as it is moved axially between die stations to form a strip of completed stamped and formed terminals. Transfer machines are commonly used to strip insulated wires and to crimp stamped and formed wire on the ends of the terminals. This invention would add additional stations to integrally form the terminal configurations on the stripped wire instead of crimping a separate stamped and formed contact terminal on the wire.

Although round wire will normally be used to fabricate terminated insulated wires with integral terminal, wires with other cross sections can also be employed. For example square wire can be employed. For some terminal configurations it may be beneficial to use a wire having a specific noncircular or irregular cross section.

For some terminals that must generate a resilient contact force when mated, the use of common copper or aluminum wire would not be appropriate. One alternative is to use wire that has sufficient spring properties for use as a resilient electrical contact. For example brass or phosphor bronze wire could be used. Of course the wire will be cold worked during the upsetting and the forming operations associated with fabrication of the terminal configurations and the properties of the material will be altered accordingly. The elasticity of the material will therefore be increased by these cold working operations.

Integrally formed mating terminals on the bare ends of stripped wires will need to be plated for the same reason as conventional stamped and formed or screw machine terminals. Instead of using conventional strip plating techniques, the terminals formed on the bare ends of the insulated wire would be dip plated. Noble metal platings such as gold over nickel or other platings such as tin lead can be applied in this manner. For miniature applications using short small wires it could even be cost effective to use gold or silver wires to eliminate the need for corrosion proof plating.

Figure 11:
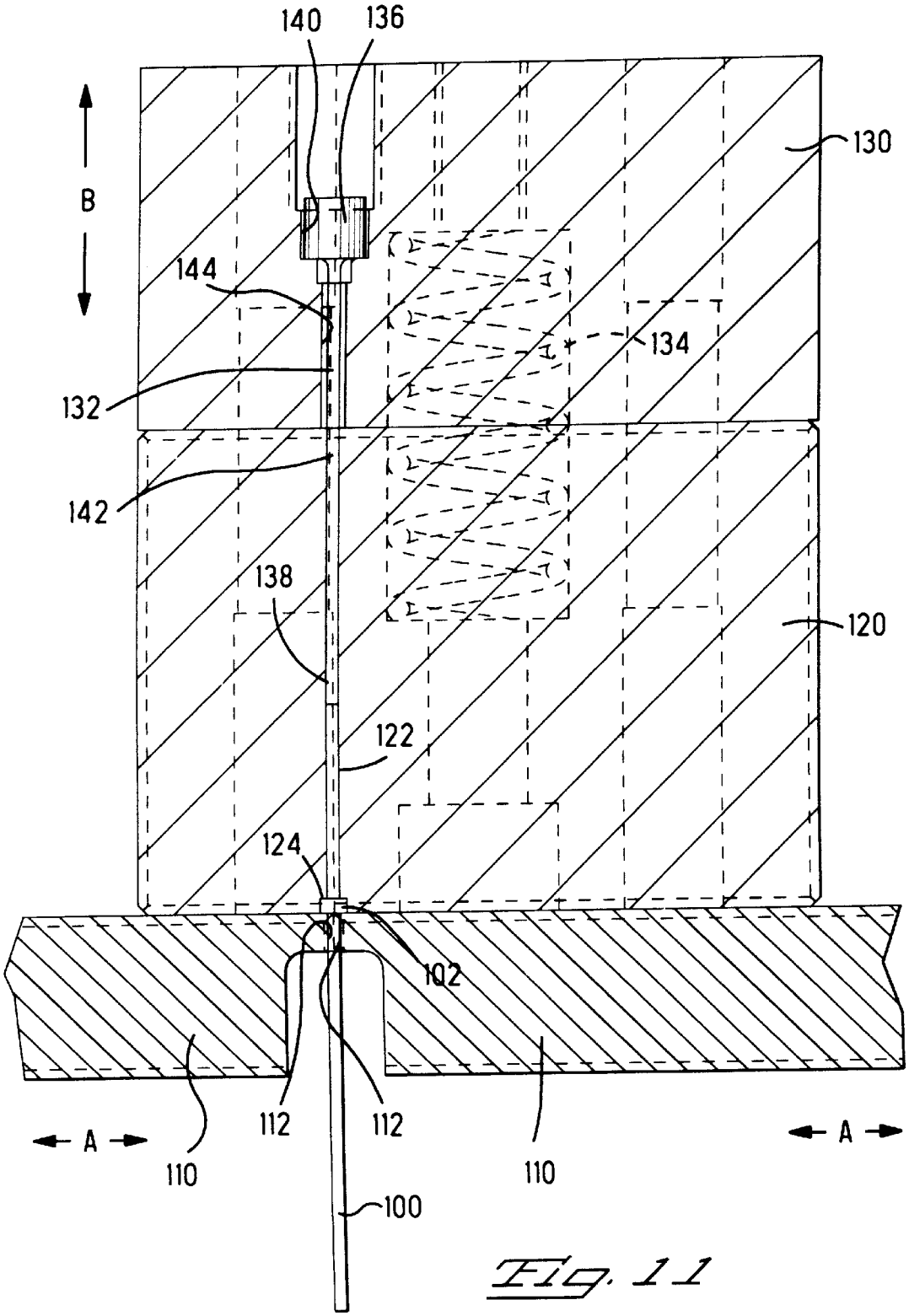
FIG. 11 shows a cross sectional view of the tooling to form the upset on the wire.

The formation of representative pin and socket contacts will now be discussed with reference to FIGS. 11–17. FIG. 11 shows the tooling to form the upset 102 on the wire 100. As shown in FIG. 11, the upset has already been formed. The tooling comprises two wire grippers 110 which each have grooves 112 to receive and grip the wire 100 therealong. The wire grippers 110 travel in towards the wire 110 and away from the wire 110 in the directions marked A. When a wire 100 is in place, the wire grippers move towards each other so that the wire is secured along grooves 112, thereby securing the wire 100.

The tooling also comprises a form insert 120. The form insert 1includes an opening 122 which extends through the form insert 120 and is aligned with the grooves 112 on wire grippers 110. A collar forming opening 124 is disposed along the opening 122, along the side of the form insert 120 proximate to the wire grippers 110. The collar forming opening 124 is the area into which the material from the wire will be forced to form the collar or upset 102.

The tooling also comprises a punch holder 130. The punch holder 130 holds and secures the punch 132 therein for operation of the punch. The punch holder 130 is connected to the form insert 120 by way of spring member 134. Other features are used to align the punch holder 130 with the form insert 120 such as aligning posts, not shown, as is known in the art. The punch 132 has a securing end 136 and a working end 138. The securing end 136 is received within an opening 140 in the punch holder 130 and is secured therein. The punch 132 has a connecting section 142 which connects the securing end 136 to the working end 138. The connecting section 142 extends through opening 144 in the punch holder 130 and into the opening 122 in the form insert 120.

During operation of the tooling, the punch holder 130 moves towards and away from the form insert 120, as is indicated by arrow B, and also pushes the punch 132 toward or away from the wire 100. Appropriate driving means are used to move the punch holder as is known in the art.

During operation of the tooling to form the collar or the upset 102, the punch holder 130 is spaced a distance from the form insert 120. The wire 100 is inserted into the opening 122 in the form insert 120, until the end of the wire abuts against the end of the punch 132. The wire grippers 110 are then moved towards each other so that the wire 100 is received in the grooves 112, thereby clamping the wire 100 in position. The punch holder 130 is then moved toward the form insert 120 with enough force to work the wire 100. The working end 138 of the punch 132 is a flat end that pushes the wire 100 backwards, towards the wire grippers 110. Since the wire 100 is securely held in place, the excess material from the wire is forced into the collar forming opening 124, thereby forming the collar or upset 102. The punch 132 moves the end of the wire 100 just enough distance in order to displace enough volume on the wire to completely fill the collar forming opening 124. As the upsetting operation is taking place, the volume of the material in the wire 100 remains constant. Therefore, it is important to make sure that the displacement by the punch is the same volume as that needed for the collar or upset. This process is known as cold heading to form an upset.

Figure 12:
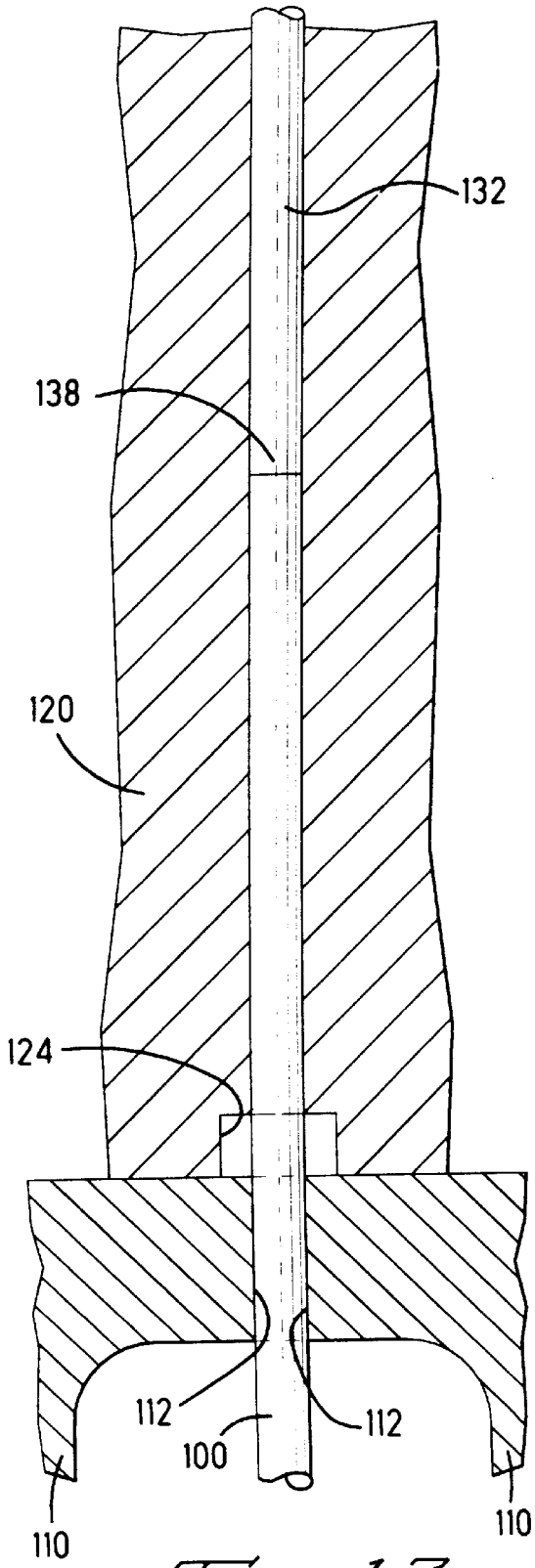
FIG. 12 is an enlarged view of the tooling showing the formation of the upset.

FIG. 12 shows an enlarged view of the upsetting operation, prior to the formation of the collar or upset 102. The wire 100 is inserted into the opening 122 until the end of the wire abuts against the end of the punch 132. The wire grippers 110 secure the wire in place so that during the operation, the material will be forced into the collar forming opening 124.

Figure 13:
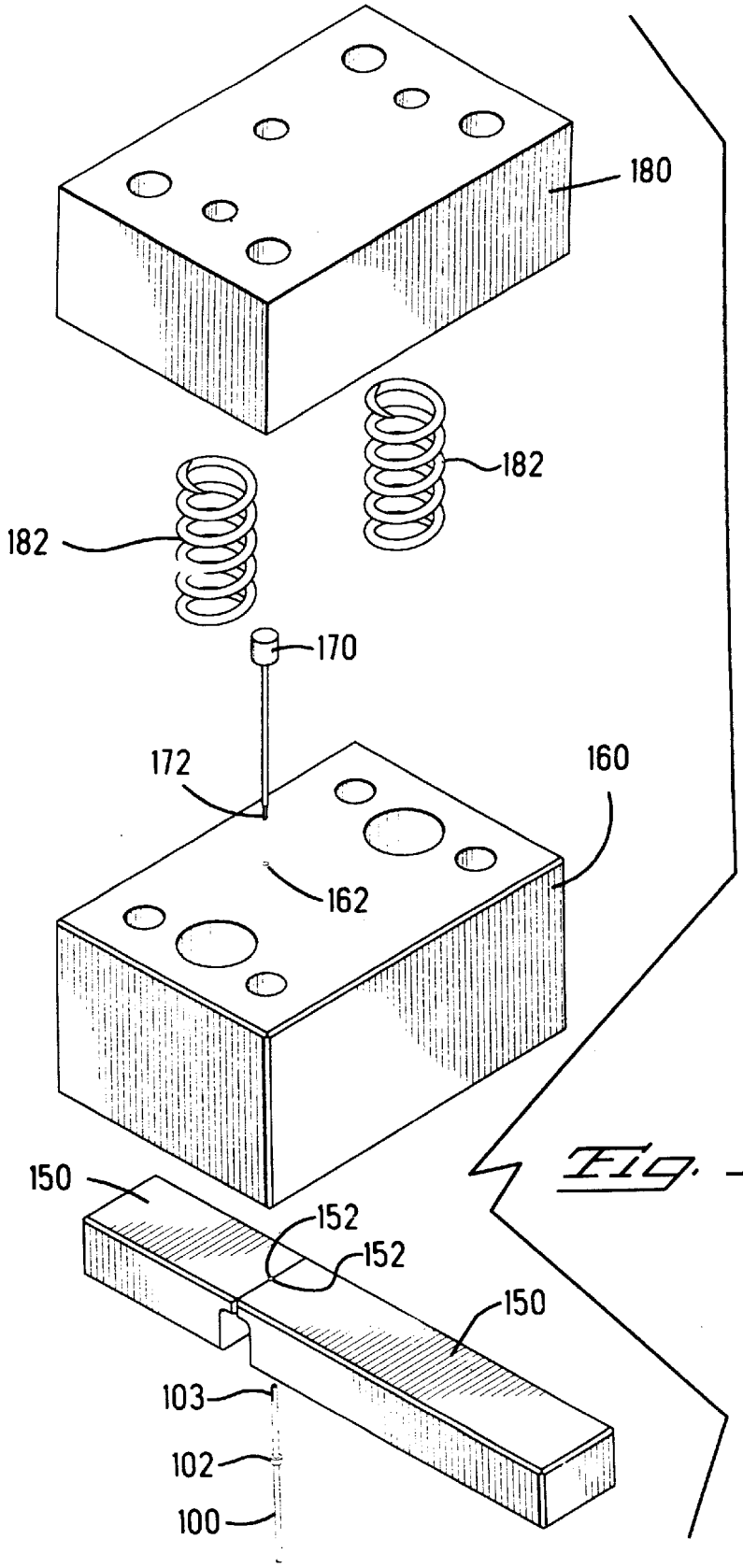
FIG. 13 is an exploded perspective view showing the tooling for forming the socket contact.

In the second step of the operation, the pin or socket contact is formed. FIG. 13 shows the tooling for forming the socket contact. The tooling is similar to the tooling for the upsetting operation in that it comprises two wire grippers 150, each having grooves 152 to receive the wire 100 therealong, a form insert 160 through which an opening 162 extends to receive the working end 172 of a punch 170 and the wire 100 to be worked, and a punch holder 180 which secures and drives the punch 170. Springs 182 are used to secure the form insert 160 and the punch holder 180 together.

Figure 14:
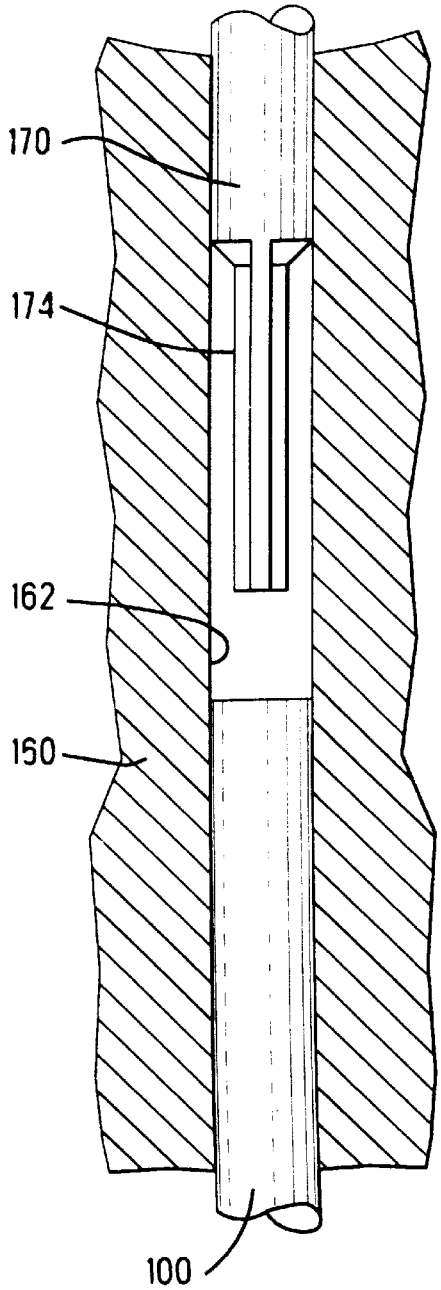
FIG. 14 is an enlarged cross sectional view showing the formation of the socket contact.
Figure 16:
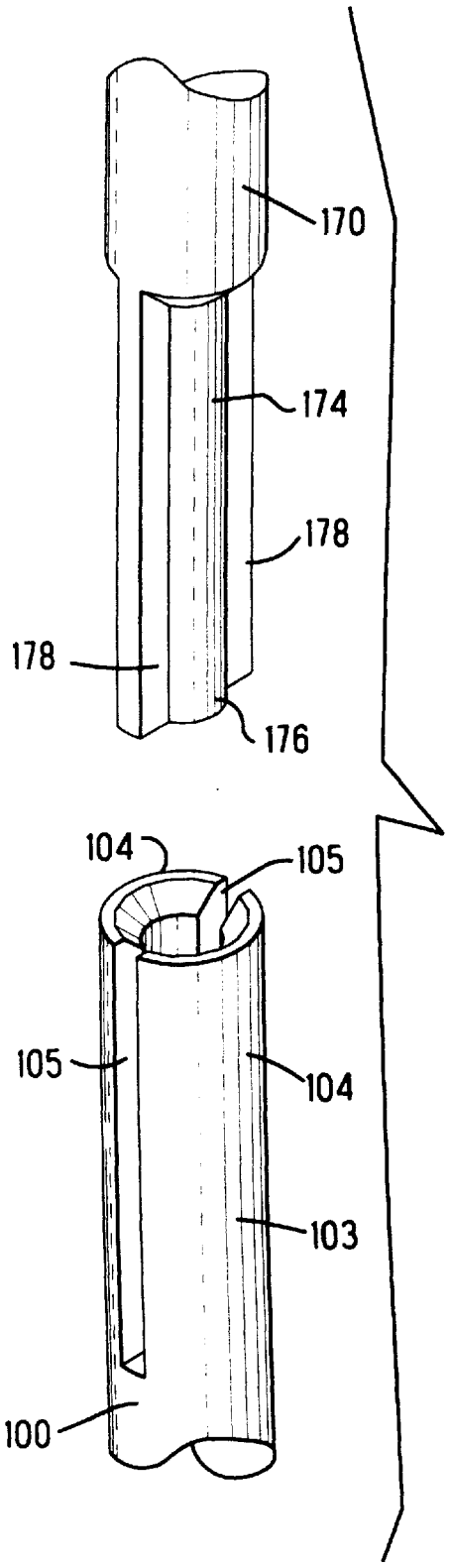
FIG. 16 is a perspective view showing the fully formed socket contact and the punch.

During operation of the tooling to form the socket contact, the wire 100 is inserted into opening 162 along with the working end 174 of the punch 170, see FIG. 14. The upset or collar 102 will be received against the bottom surface of the form insert 160 or, alternatively, it is received within a recess along the bottom surface. The upset or collar 102 will act as a stop in limiting how far the wire is inserted into the form insert 160. FIG. 16 shows the details of the working end 174 of the punch 170. The working end 174 has a central circular section 176 with flanges 178 extending outwardly from the circular section 176. The outer edges of the flanges 178 are designed to abut against the walls of the opening 162.

Figure 15:
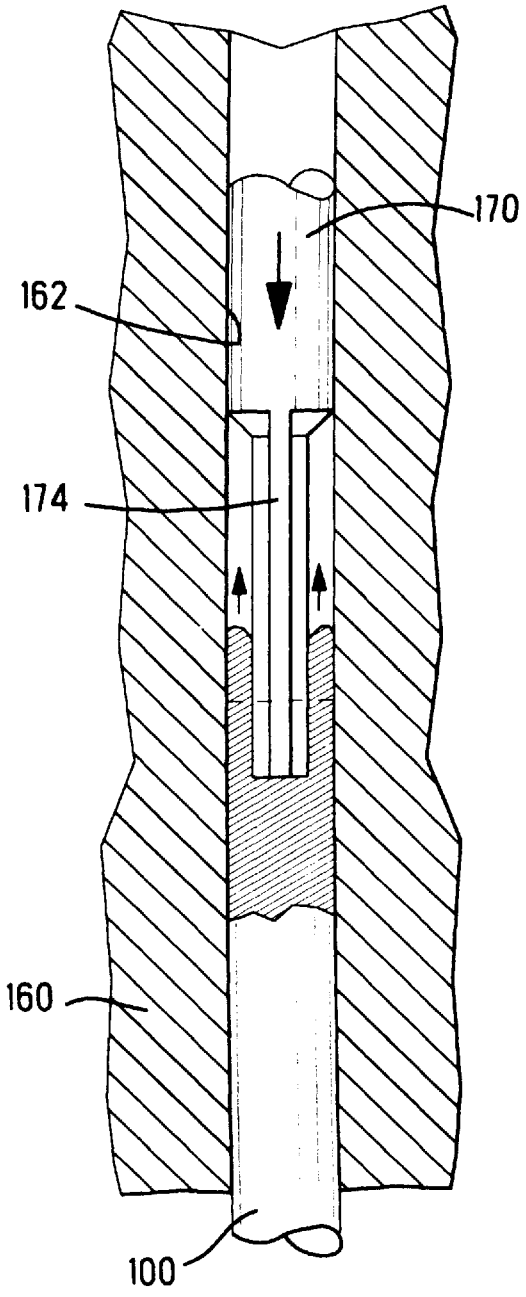
FIG. 15 shows the formation of the socket contact.

During operation, the working end 174 of the punch 170 is forced down against the straight end of the wire 100, see FIG. 14. As the punch 170 engages the end of the wire 100, the material from the wire is forced upwardly, as shown in FIG. 15, around the end of the punch 170, in a reverse draw procedure. The punch 170 is forced downwardly until the material from the wire 100 is force up into the area around the circular section 176 and the flanges 178.

FIG. 16 shows the socket contact 103 which results from the operation. The socket contact 103 has two fingers 104 with slots 105 formed therebetween. The fingers 104 are able to flex around a pin contact because of the slots 105.

Figure 17:
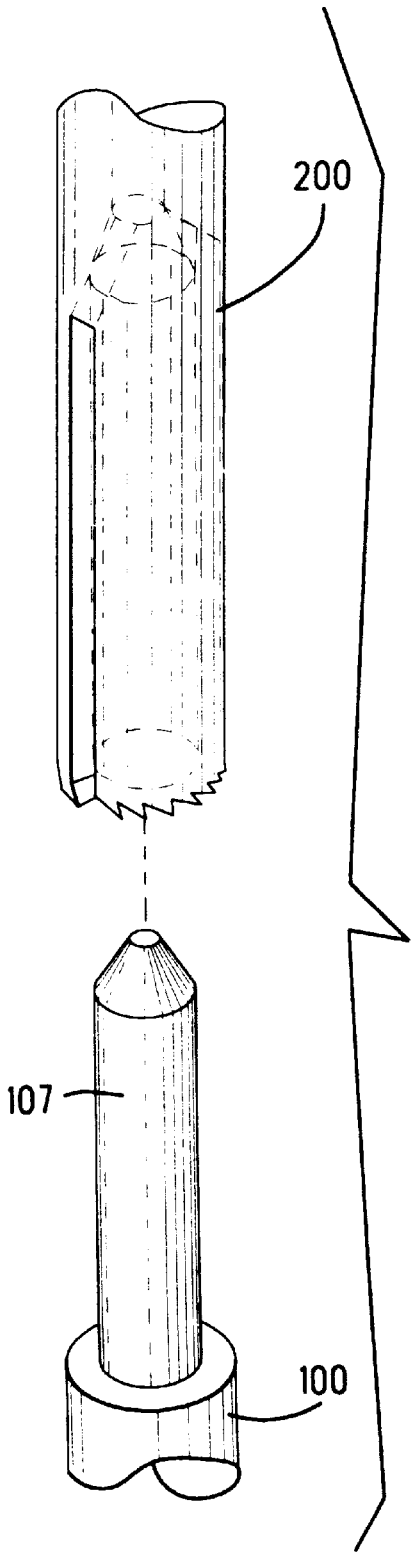
FIG. 17 is a perspective view showing the fully formed pin contact and the cutting tool used to form the pin contact.
Figure 18:
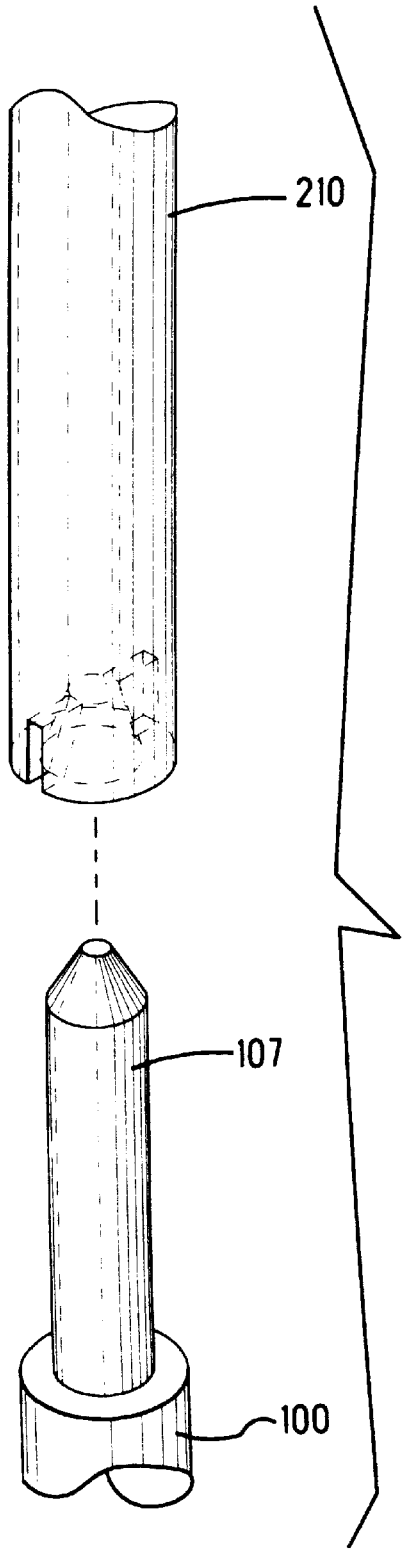
FIG. 18 is a perspective view showing an alternative cutting tool used to form the pin contact.

In a similar manner, a pin contact 107 can be formed on the end of the wire 100. The upsetting process can be used to form a collar or an upset in a similar manner as was described above. FIG. 17 shows one method in which the pin contact 107 can be formed. A cutting tool 200 is pushed down over the straight end of the wire 100, thereby grinding and cutting the wire down to the proper size for the pin contact. This method can be used for wires that are very hard such as stainless steel wire. Alternatively, a second related method can be used to fabricate pin terminal configurations. The stripped bare wire end can be first coined and then the edges of the coined section can be trimmed in a stamping operation to remove excess material and form the pin into a square. The square section can then be coined into a circular pin. The remaining coined section can then be formed in a die into a terminal shape. Finally, the end of the pin can be former by using a cutting tool 210 such as shown in FIG. 18. The cutting tool 210 is used to form the chamfered shape of the tip of the pin 107 after the sides of the pin are formed from the method described above. This is a more useful method for fabricating pins from copper and copper alloy wires.

The procedures described above are representative methods which can be used to form the contacts on the ends of stranded wire. Other procedures are known in the art which can be used to form similar or the same contacts as shown in the drawings.

The representative embodiments discussed herein are not the only terminals that can be integrally formed on the stripped bare ends of insulated wires. It would be impossible to list all of the configurations that could be fabricated according to this invention. Therefore the following claims, and not the details of the representative embodiments, define this invention.

I Claim:

1. A method of terminating an insulated wire comprising the steps of:

stripping insulation from a first end of the wire to expose a first wire section for a first length;

upsetting the first wire section to increase the cross sectional area of an upset portion of the first wire section by reducing the length of the first wire section to a second length, less than the first length; and forming the first wire section into a mating configuration for connection to a mating connector, whereby the wire can be connected to the mating connector without attachment of a terminal to the first end of the wire.

2. The method of claim 1 wherein the upset portion of the first wire section is formed in a mating configuration.

3. The method of claim 2 wherein the upset portion is formed as a male pin have a generally cylindrical configuration.

4. The method of claim 2 wherein the upset portion is formed as a female socket.

5. The method of claim 2 wherein the upset portion is formed as a male tab having a generally rectangular cross section.

6. The method of claim 1 wherein the upset portion of the first wire section is spaced from the first end of the wire.

7. The method of claim 6 wherein the upset portion is formed as a shoulder for engaging a surface on a housing to position the first wire section in the housing.

8. The method of claim 1 wherein the first wire section is formed by stamping and forming the first wire section.

9. The method of claim 1 wherein the first wire section is formed by drilling and reaming the first wire section.

10. The method of claim 9 wherein the upset portion is drilled and reamed.

11. The method of claim 1 wherein both ends of the wire are stripped, upset and formed into a mating configuration so that the wire can be connected to mating terminals on both ends.

12. The method of clam 11 wherein the first end of the wire is formed in a male configuration and an opposite second end of the wire is formed in a female configuration.

13. The method of claim 1 wherein the first wire section is formed as a hermaphroditic blade matable with a configuration identical to the blade.

14. The method of claim 1 wherein the wire is coined along the first wire section to form protruding retention surfaces extending radially beyond the other portions of the first wire section.

15. The method of claim 1 wherein the first wire section has a circular cross section prior to the upsetting and the forming steps.

16. A method of terminating an insulated wire comprising the steps of:

stripping insulation from a first end of the wire to expose a first wire section for a first length;

coining a first part of the first wire section;

trimming at least part of the first coined portion of the first wire section to remove material and to decrease the cross sectional area of the first coined part of the first wire section; and forming the first coined part of the first wire section into a mating configuration having a cross sectional area less than the original cross sectional area of the wire for connection to a mating connector, whereby the wire can be connected to the mating connector without attachment of a terminal to the first end of the wire.

17. The method of claim 16 wherein the wire is coined along as second part of the first wire section to form protruding retention surfaces extending radially beyond the other portions of the first wire section.

* * * * *